United States Patent [19]

Rojas

[11] Patent Number: 4,839,934

[45] Date of Patent: Jun. 20, 1989

[54] MULTIPLE COMPONENT COMFORTER QUILT

[76] Inventor: Robert R. Rojas, 300 E. 33rd St., Box 268, New York, N.Y. 10016

[21] Appl. No.: 108,106

[22] Filed: Oct. 13, 1987

Related U.S. Application Data

[63] Continuation-in-part of Ser. No. 864,823, May 19, 1986, abandoned.

[51] Int. Cl.[4] ..... A47G 9/02

[52] U.S. Cl. ..... 5/502; 5/485; 5/486

[58] Field of Search ..... 5/502, 500, 485, 482, 5/420, 486

[56] References Cited

U.S. PATENT DOCUMENTS

| | | | |
|---|---|---|---|
| 429,894 | 6/1890 | Doremus | 5/502 |
| 1,394,061 | 10/1921 | Bernstein | 5/480 |
| 2,224,300 | 12/1940 | Johnson | 5/471 |
| 2,248,768 | 7/1941 | Licht | 5/502 |
| 2,263,810 | 11/1941 | Leslie et al. | 5/502 |
| 2,399,235 | 4/1946 | Leslie | 5/502 |
| 2,596,547 | 5/1952 | Guest | 5/502 |
| 4,079,568 | 3/1978 | Wortman | 5/502 |
| 4,274,169 | 6/1981 | Standiford | 5/502 |
| 4,573,227 | 3/1986 | Prandina | 5/502 |

FOREIGN PATENT DOCUMENTS

| | | | |
|---|---|---|---|
| 353162 | 5/1922 | Fed. Rep. of Germany | 5/502 |
| 491524 | 2/1930 | Fed. Rep. of Germany | 5/502 |
| 683651 | 11/1939 | Fed. Rep. of Germany | 5/420 |
| 159495 | 9/1940 | Fed. Rep. of Germany | 5/502 |
| 564949 | 7/1957 | Italy | 5/485 |
| 442583 | 2/1936 | United Kingdom | 5/502 |
| 927094 | 5/1963 | United Kingdom | 5/485 |

*Primary Examiner*—Alexander Grosz

*Attorney, Agent, or Firm*—Howard I. Podell; David P. Gordon

[57] ABSTRACT

The invention is an improved bed covering multiple component comforter formed with a container-cover unit containing removable and interchangeable insulator pad units enclosing heat insulating material such as down. The pads are each held in place in compartments or channels of the container-cover. The pad units may be removed prior to washing or dry cleaning of the container-cover. Similarly, the pad units may be washed independently of the container-cover, when removed. The container-cover may be made of one of a number of different decorative fabrics, with the user applying the pads units into the particular container-cover that is to be used at the moment. Each compartment opening through which a pad unit is to be inserted may be fitted with a flap that overlaps the opening of the compartment to prevent inadvertent removal of the pad. A flexible tape device may also be employed to fasten the openings of the compartments in use. Insulator pad units of different heat insulating characteristics may be individually assembled in the compartments of the container-cover to form selective heat insulation zones.

18 Claims, 3 Drawing Sheets

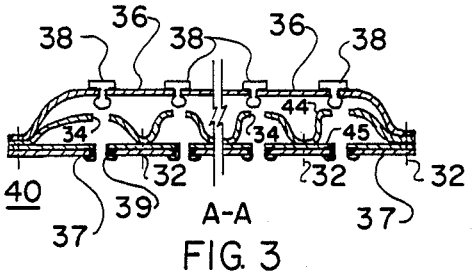
FIG. 3
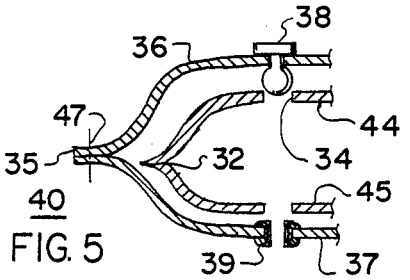
FIG. 5
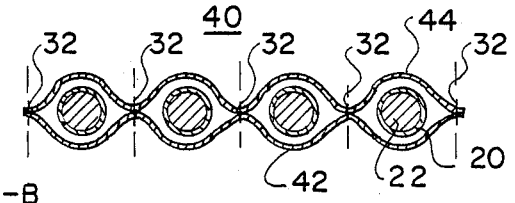
B-B
FIG. 4
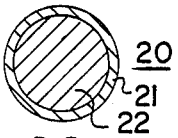
D-D
FIG. 2
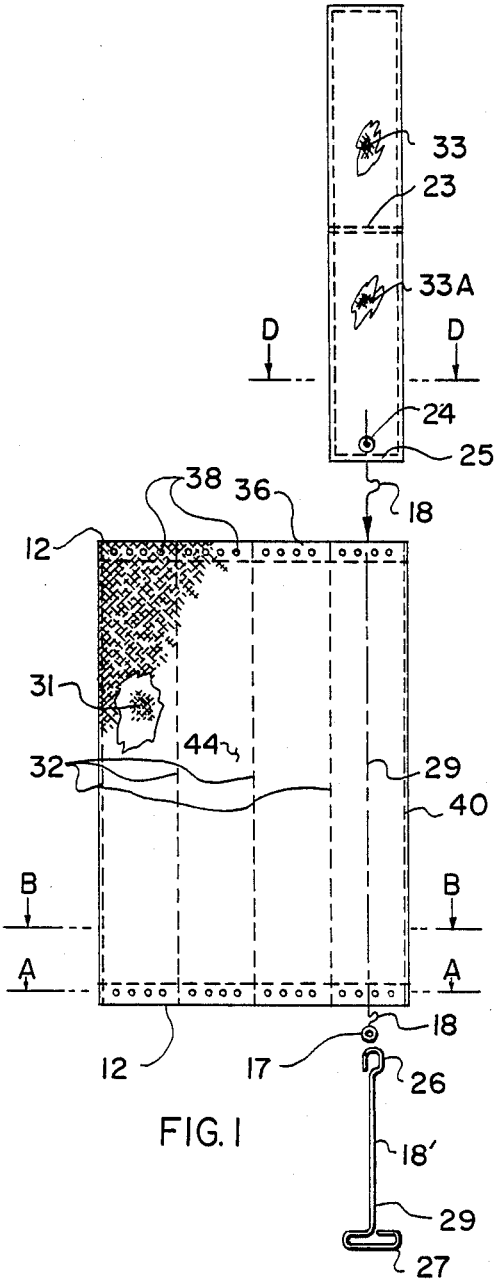
FIG. 1
FIG. 6

MULTIPLE COMPONENT COMFORTER QUILT

This is a continuation-in-part of Ser. No. 864,823, filed May 19, 1986, now abandonned.

FIELD OF THE INVENTION

This invention relates to an improved multiple component comforter bed covering fitted with removeable and/or interchangeable heat insulation unit pads.

BACKGROUND OF THE INVENTION

Blankets and quilts and related items in the the field of the invention are disclosed in U.S. Pat. Nos. 429,894, 1,267,042, 2,224,300, 2,248,768, 2,263,810, 2,399,235, 2,596,547, 3,331,088, 3,381,321, 4,079,568, 4,274,169, 4,573,227.

The following foreign patents are also of interest: Italy Pat. No. 564,949, U.K. Pat. Nos. 442,583 and 927,094, Germany: Pat. Nos. 159,495, 353,162, 491,524, and 683,651.

These bed covers of the prior art do not suggest the simplicity and effectiveness of the applicant's multiple component comforter nor the comforter structure of the invention.

SUMMARY OF THE INVENTION

The invention is an improved bed covering multiple component comforter formed with a container-cover unit containing removable pad units enclosing heat insulating material such as down or synthetic plastic material. The pads are each held in place in compartments or channels of the container-cover. The pad units may be removed prior to washing or dry cleaning of the container-cover. Similarly, the pad units may be washed independently of the container-cover, when removed. The container-cover may be made of one of a number of different decorative fabrics, with the user applying the pads units into the particular container-cover that is to be used at the moment.

Container-covers of a particular set may be of varying sizes, with each fitted with a different number of a similar uniform size compartments so that varying quantities of uniform size insulator pad units may be employed in any container-cover of the set, with each size container-cover of a size to fit a particular size bed, such as king size, queen size double size, twin size, junior size or even crib size.

Each compartment opening through which a pad unit is to be inserted may be fitted with a flap that overlaps the opening of the compartment to prevent inadvertent removal of the pad. A flexible tape device may also be employed to fasten the openings of the compartments in use.

A series of parallel channels, running the length or width of the container-cover may serve as compartments. Alternatively, the compartments may be located in a grid pattern. Where the openings of one set of compartment face the openings of a second set of compartments, an overlapping flap may be stitched along an axis between the two set of openings so as to overlap the openings of both sets of compartments. Preferably the compartment openings and overlapping flaps are located on the underside of the container-cover, so that the external face side forms a continuous surface and may be of a design to simulate a conventional quilt formed with fixed insulation. Adjoining compartments may be separated from each other by a seam line of stitching which may run along a diagonal axis so as to form triangular shaped compartments, enabling the user to insert a triangular shaped pad into each such compartment with a minimum of friction, by pointing an angular corner of the triangular pad into the opening of the compartment, when inserting the pad.

BRIEF DESCRIPTION OF THE DRAWINGS

The objects and features of the invention may be understood with reference to the following detailed description of an illustrative embodiment of the invention, taken together with the accompanying drawings in which FIG. 1 is an exploded bottom plan view of a twin size container-cover unit together with an insulator pad about to be inserted into the container-cover;

FIG. 2 is a cross-sectional view of the unit comforter of FIG. 1, taken along line D—D of FIG. 1;

FIG. 3 is a detail sectional view of the container-cover unit in the open position, taken at line A—A of FIG. 1;

FIG. 4 is a detail sectional view of the container-cover unit with all insulator comforter pads in place, taken at line B—B of FIG. 1;

FIG. 5 is a detail sectional exploded view of an alternative embodiment of the tape unit and container-cover opening section shown in FIG. 3, taken at line A—A of FIG. 1;

FIG. 6 is a plan view of a puller member;

DESCRIPTION OF THE PREFERRED EMBODIMENT

Figure 7:
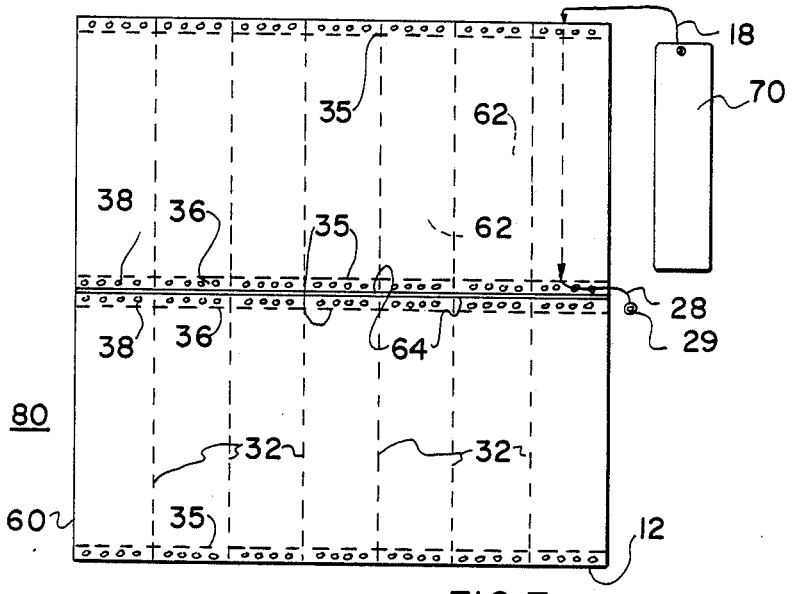
FIG. 7 is a bottom plan view of an alternative embodiment of the container-cover unit together with one insulator pad unit prior to final installation of the insulator pad unit.
Figure 7A:
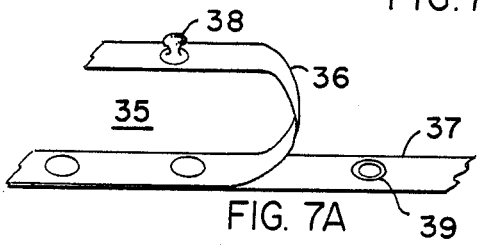
FIG. 7A is a detail perspective view of the latch tape.

Turning now descriptively to the drawings, FIG. 1 illustrates the the multiple component comforter of my invention which is an assembly made up of an outer container-cover 40, enclosing compartments 31 which may be each be filled in use by insulator pads 20. Each container-cover 40 is formed of an upper sheet 45 fastened by seams 32 to a lower sheet 44, with the seams 32 bounding a plurality of interior compartments 31 formed with openings 12 at opposed compartment end sections. Each of the compartments may be filled by a insulator pad 20 that is formed of heat-insulating material, such as down 22, enclosed in a flexible container-cover 21. The unit insulator pad 20 is inserted or removed through an end opening 12 of the compartment 31.

Each unit insulator pad 20 is a soft, flexible pad formed in a somewhat cylindrical shape as shown in FIGS. 1 and 2. The insulator pad 20 may be uniformly filled with insulation material throughout its length, or alternatively one or more baffles may be formed by means of seams 23 to separate the insulator pad into individual compartments 33, with each of these compartments 33 being filled with different amounts of insulation material or with insulation material of different characteristics, so that one section of the insulator pad will provide more warmth to the user, than another section.

A pull member 29 such as flexible string 18 or a shaped rod 18' may be attached to one end section 25 of a insulator pad 20, preferably by a hook fitted to the string end, with said hook of a size to detachably attach to an eyelet 24 mounted in the end section 25 of the insulator pad and with an eyelet 17 fastened to the opposed end of the string 18. As shown in FIG. 6, shaped thin rod 18' is formed at one end as a hook section 26 and at the opposed end with a handle-shape section 27 and may be employed in conjunction with, or instead of a flexible string 18 to serve as the pull member 29. The pull member 29 is initially inserted into a compartment 31 through one one end opening 12 and out of the opposed end compartment opening 12 to either fasten into eyelet 24 of an insulator pad, or into an eyelet 17 fastened to the end of a flexible string 18. As shown in FIG. 6, the pull member extends away from the insulator pad to which it is fastened. After serving its purpose in pulling an insulator pad 20 into a compartment 31, the pull member may be detached from the unit insulator pad 20.

The container-cover member 40 of multiple component comforter assembly shown in FIG. 1 is of a size to fit a twin bed, being formed with 4 parallel compartment sections 31 or channels, each adaptable to receive a insulator pad 20 of a uniform size. Other container-cover members may be formed of larger widths to fit beds of normal double size bed width, or of queen size or king size width, with all such container-covers of a set fitted with various number of uniform size compartments so that the insulator pads 20 may be freely transferred into or out of any compartments of the different width container-cover members of the set. Conversely, different insulator pads of a substantially uniform size may be fabricated with different heat insulation characteristics. In this manner, when similar size insulator pads 20 of different heat insulation properties are assembled into the one container-cover unit, the container-cover unit is formed with different "heat zones" in use. One lateral side of an assembled comforter may provide more heat insulation than the other side so as to keep the user under the first lateral side warmer under the comforter than the user under the other side.

The container-cover sections can be readily fabricated of different conventional sizes, employing uniform size compartments to individually each retain a similar shape insulator pad 20. Similar shape insulator pads 20 may be inserted by the user into container-cover sections of different sizes and or different decorative design. Alternatively, the insulator pads 20, while of similar interchangeable shape, may be formed with different heat insulation properties.

The container-cover unit 60 and insulator pad units 70, as shown in FIG. 7, are formed so as to provide a potential for different "heat zones" in both lateral sections and longitudinal sections of the assembled unit 80.

Heat zones of different insulation characteristics may also be achieved throughout the length of the comforter by employing insulator pads 20 as shown in FIGS. 1–2 fitted with one or more baffles 23 which divide an individual insulator pad 20 into two or more compartments which are filled with different amounts of insulation material 22 or filled with insulation material of different insulating characteristics such as 33 and 33A respectively, so that one insulator pad will provide different degrees of warmth to the user, along the longitudinal length of the assembly 40.

As shown in FIG. 7, the insulator pads 70 are each of a length substantially half the longitudinal length of the container-cover unit 60, as compared to the insulator pads 20 which are substantially the full length of the container-cover unit 40. Insulator pad units 70 may be fabricated with varying amount of insulation filling or with filling material of differing insulation properties. Each compartment 62 runs half the length of the container-cover 60 with each compartment 62 fitted with an end opening 12 at an external end of the container-cover unit 40 and also fitted with an end opening 64 at a mid-section of the container-cover unit. Openings 64 lie along a common lateral line on the underside of the container-cover unit 40.

As shown in FIGS. 1, 3, 5–7 and 7A, compartment openings 12 and 64 may be fastened into the closed position to prevent the insulator pad 20 from slipping out of compartments 31 or 62 by means of a latching tape 35 unit. Tape unit 35 is formed with an under length 36 to which a series of spaced male snap fasteners 38 are fixed, and an upper length 37 fitted with a series of spaced female snap fasteners 39. The border sections of end openings 12 or 64 are formed with a spaced series of button hole openings 34, with openings 34 and fasteners 38 and 39 being uniformly spaced so that in the fastened mode, each male fastener 38 is located to fit through the holes 34 of the container-cover edges to detachably mate with a female fastener 39. Both tape upper and lower tape lengths 37 and 36 may be formed of a common length or they may be separate members, and if separate tape members, they may be joined by a seam 47 at one end. The upper tape length may be permanently joined to the upper container-cover sheet 45, or the female fasteners 38 may be permanently mounted through the holes 34 of the bottom container-cover sheet 44 to eliminate the requirement for a separate bottom tape length 36.

FIG. 7 illustrates a container-cover unit 60 formed with seven parallel columns of compartments, with compartment openings 64 along the mid-section of the container-cover units permitting the use of insulator pad units 70 of half the full length of the container-cover unit so that each column of compartments will hold two insulator pad units providing for use of insulator pad units of different heat insulation properties in the head end and foot end of each assembly 80.

The multiple component container-cover units 60 may be fabricated from an assembly of two sheets of fabric of a given width and then cut along a seam 32 to form a unit as shown in FIG. 7 of a width K, Q, F, or T formed of seven to four parallel columns of similar size compartments respectively, to form container-cover widths to fit a King size, Queen size, Full size, Twin size bed, respectively. Smaller size container-covers shaped with a fewer number of the same size compartments may be shaped to fit smaller size beds such as a junior size bed or a crib size bed.

Figure 8:
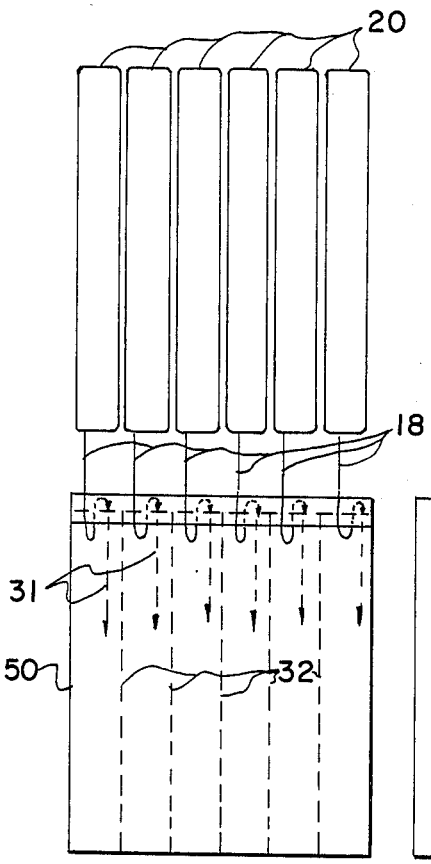
FIG. 8 is an exploded bottom plan view of an alternative form of a comforter module assembly, prior to final insertion of the insulator pad units.
Figure 9:
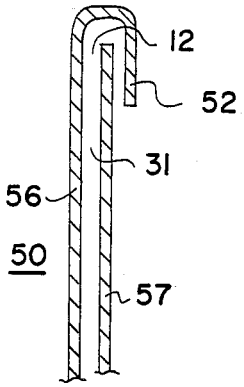
FIG. 9 is a detail cross-section view of a container-cover unit fitted with a flap.
Figure 8A:
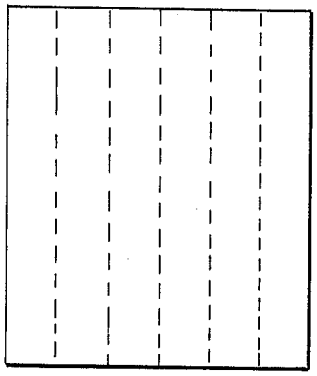
FIG. 8A is a top plan view of the embodiment illustrated in FIG. 8, after insertion of the insulator pad units.

As shown in FIGS. 8 and 9, a container-cover unit is fitted with six sets of parallel compartments sections 31 of the same size as those of container-cover unit 40, with container-cover unit 50 being sized to fit over a queen size bed (not shown). Similarly other container-cover units formed with five sets of identical size compartment sections 31 would fit a double size bed, while a container-cover unit formed with seven identical size compartments would fit over a king size bed. A container-cover unit with still more such compartments would fit over a California king size bed.

A flap section 52 of fabric is fitted to extend container-cover opening 12 and fastened to the face sheet 56 of container-cover 50. Flap section 52 is also held to the under sheet 57 by spaced seams 32 which bounds compartments 31. A insulator pad 20 may be slid under the flap into a compartment 31, with the flap holding the insulator pad unit in place in compartment 31.

Figure 10:
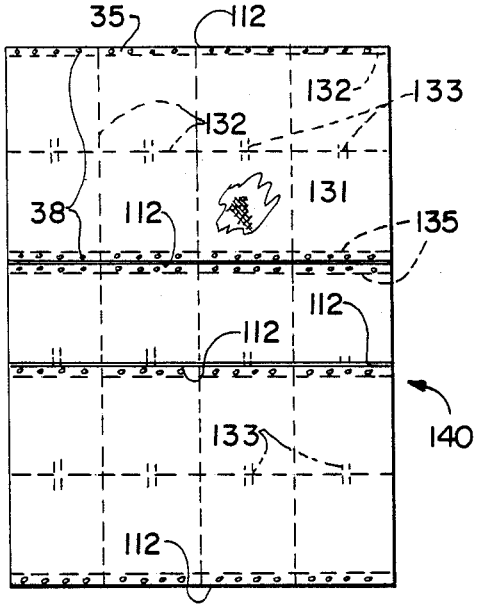
FIG. 10 is a bottom plan view of another alternative embodiment of the invention.
Figure 15:
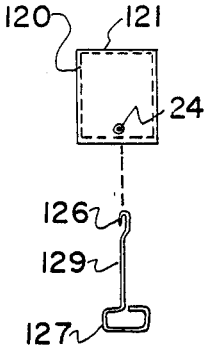
FIG. 15 is an exploded plan view of an alternative embodiment of the pull member of FIG. 6 and a pad unit to which it is to be attached.
Figure 11:
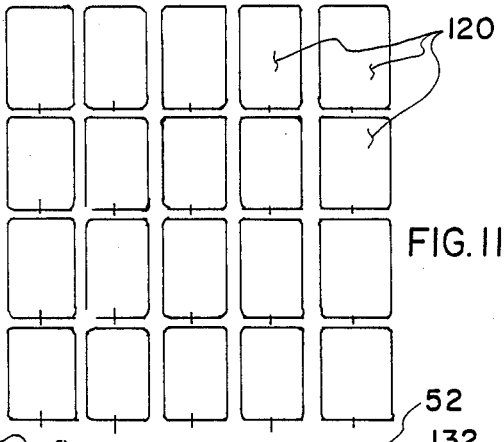
FIG. 11 is an exploded bottom plan view of another alternative embodiment of the invention, showing the insulator pad units and container-cover units, prior to installation of the pad units.
Figure 12:
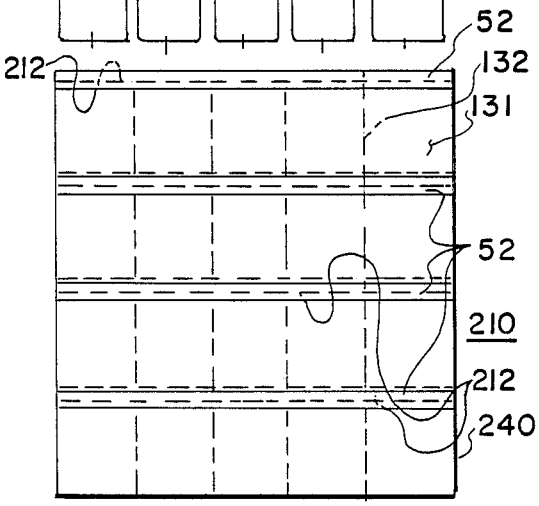
FIG. 12 is a top plan view of either of the embodiments illustrated in FIG. 10 or FIG. 11 after insertion of the insulator pad units.
Figure 12:
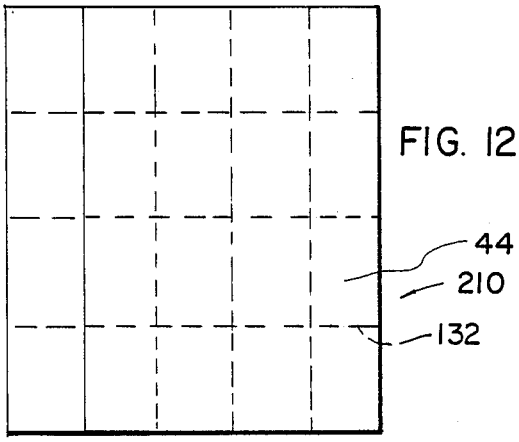

FIGS. 10 and 11 illustrate embodiments of the invention in which the insulator pad units are in the general form of rectangular pads 120, each about one-fourth of the length of the multiple component comforter assembly. FIG. 10 illustrates the multiple component comforter 110 of my invention which is each made up of an outer container-cover 140, with compartments 131 which may be each be filled in use by insulator pads 120. Each container-cover 140 is formed of an upper sheet fastened by a grid of seams 132 to a lower sheet 44, with the seams 132 bounding a plurality of interior compartments 131 formed with openings 112 at opposed end sections of each compartment. Each of the compartments may be filled by a insulator pad 120 that is formed of heat-insulating material such as down 22, enclosed in a insulator pad cover 121. The insulator pad 120 is inserted or removed through an end opening 112 of the compartment 131. As shown in FIG. 10, an opening 133 may be provided in lateral seams 132 to enable the hook 126 and rod of a pull member 127 to extend through the opening 133 from a compartment 131 beyond the opening 112 of an adjacent compartment so as to fasten to an eyelet 24 of a insulator pad 120 to enable the user to grasp the handle 127 of the pull member and pull the insulator pad into its appropriate compartment. As shown in FIG. 15, hook section 126 of the pull member is formed of a shape to readily slip through opening 133 and to readily fit into or out of eyelet 24, as desired. As shown in FIGS. 10 and 15, opening 133 in the seam 132 is of smaller cross-section than that of an insulator pad 120 which is filled in use in a respective compartment 131 so that the insulator pad 120 cannot slip out of the compartment through the opening 133 that has been provided for extending the pull member 127 through opening 133.

The insulator pads 120 are each individually retained in a compartment 131 by a strap assembly 135 which closes the compartment opening 112. Since the pads 120 may be made with differing heat insulation qualities, the user may custom assemble a multiple component comforter 110 with varying qualities of heat insulation throughout the grid of sixteen different compartments 131 by selected use of pads 120 of different insulation properties. In this fashion the multiple component comforter assembly may be assembled to fit the particular warmth requirements of the user, and in the case of double size assemblies, the particular warmth requirements of the different users. The grid of sixteen pads permits change of "heat zones" along both lateral and longitudinal axes of the assembly and permits the user to readily make seasonal changes of heat insulation properties of the comforter assembly.

FIG. 11 illustrates the multiple component comforter 210 of my invention which is made up of an outer container-cover 240, with compartments 131 which may be each be filled in use by insulator pad units 120. Each container-cover 240 is formed of an upper sheet fastened by a grid of seams 132 to a lower sheet 44, with the seams 132 bounding a plurality of interior compartments 131 formed with openings 212 at at least one end section of each compartment. Each of the compartments may be filled by a insulator pad 120 that is formed of heat-insulating material such as down 22, enclosed in a insulator pad cover 121. The insulator pad 120 is inserted or removed through an end opening 212 of the compartment 131. A flap section 52 of fabric is fitted to extend over each compartment opening 212 and is fastened to sheet 44 of the container-cover. Flap section 52 is also held to the under sheet of the container-cover by spaced seams 32 which bound compartments 131. A insulator pad unit 120 may be slid under the flap into a compartment 131, with flap section 52 holding the insulator pad unit 120 in place in its compartment 131.

Figure 13:
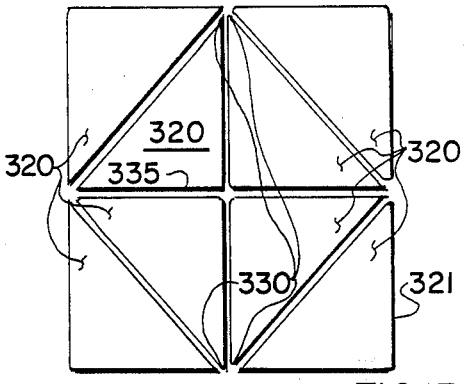
FIG. 13 is an exploded bottom plan view of another alternative embodiment of the insulator pad units of the invention, showing the insulator pad units, prior to installation.
Figure 13A:
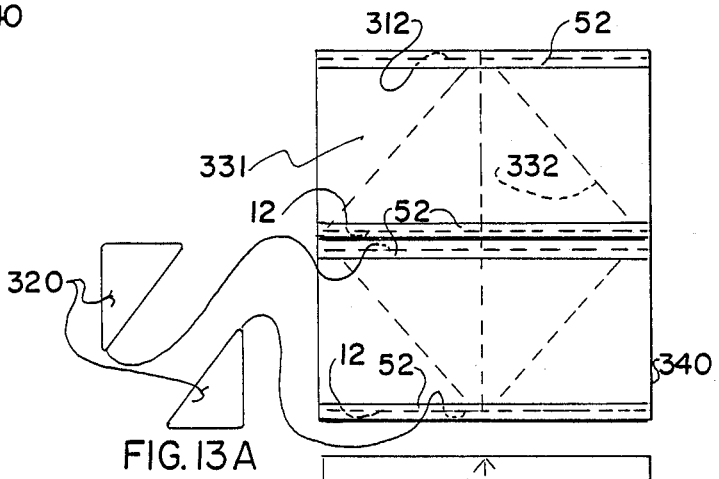
FIG. 13A is an exploded bottom plan view of the alternative embodiment of the invention into which the insulator pad units illustrated in FIG. 13 are installed.
Figure 14:
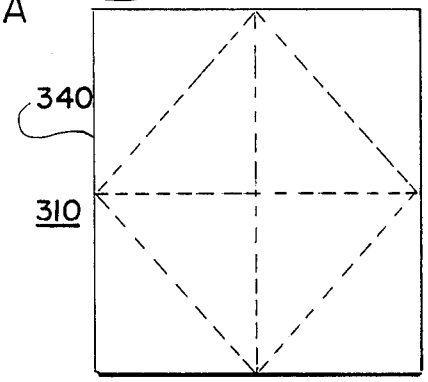
FIG. 14 is a top plan view of the embodiment of FIG. 13 after insertion of the insulator pad units.

FIGS. 13, 13A and 14 illustrate an embodiment 310 of the invention in which the insulator pad units are in the general form of triangular pads 320, each about one-eighth of the area of the multiple component comforter assembly. FIG. 13 illustrates the multiple component comforter 310 of my invention which is made of an outer container-cover 340, with triangular-shaped compartments 331 which may be each be filled in use by a triangular-shaped insulator pads 320. Each container-cover 340 is formed of an upper sheet 44 fastened by a grid of seams 332 to a lower sheet 45, with the seams 332 bounding a plurality of interior compartments 331 formed with openings 312 at one end section of each compartment. Each of the compartments may be filled by a heat insulator unit that is formed of heat-insulating material such as down 22, enclosed in a insulator pad container-cover 321. The unit insulator pad 320 is inserted or removed through an end opening 312 of the compartment 331. The triangular shape of compartments 331 and of insulator pads 320 enables the user to readily insert an insulator pad into a compartment with a minimum of friction by inserting a apex section of the insulator pad 320 initially into the compartment opening 312. The edges of the insulator pad do not become engaged and are not restrained by the corresponding compartment edges until the pad is fully seated in the compartment.

The insulator pads 320 are each individually retained in a compartment 331 by a strap assembly 35 which closes the compartment openings 312. Since the pads 320 may be made with differing heat insulation qualities, the user may custom assemble a multiple component comforter 310 with varying qualities of heat insulation throughout the triangular grid of eight different compartments 331 by selected use of pads 320 of different insulation properties. In this fashion the multiple component comforter assembly may be assembled to fit the particular warmth requirements of the user, and in the case of double size assemblies, the particular warmth requirements of the different users. The triangular grid of eight insulator pads permits change of "heat zones" along both lateral and longitudinal axes of the assembly and permits the user to readily make seasonal changes of heat insulation properties of the comforter assembly. The triangular shaped compartments and pads permit an apex section 330 of each pad 320 to be initially inserted into a compartment opening 312 that is of the general width of a base section 335 of the pad so as to simplify insertion of a triangular shaped pad into a triangular shaped compartment. The multiple component dimensions of my insulator pad units provides the user with the ability to produce a comforter assembly of custom-made properties. Thus a quilt unit may be assembled with pads of different heat insulation properties to ensure more warmth to the feet of one user as compared to the resultant warmth about the feet of an adjacent bed mate, with similar individual custom-designed insulation zones created for the sections of the quilt assembly lying over different portions of the body of each of the individual users. Pads of different insulation qualities may be installed as seasonal needs dictate, and container-covers and pads may be separated for washing of the container-cover units, or for change of design of a container-cover unit.

Insulator pad units may be made not only of varying heat insulation properties but with other individual characteristics such as anti-allergic properties. Thus for a user with an allergy to down fillings, unit insulator pads may be provided with synthetic hypo-allergenic properties made of plastics such as polyester. The user can locate the polyester-filled insulator pad units near the head end of the comforter assembly, and locate down-filled insulator pad in the foot end of the assembled comforter.

Furthermore the multiple component design of my invention permits the manufacturer or the user to form comforter container-covers of a particular size from larger multiple component container-covers by cutting along longitudinal seams that separate compartments of the container-cover. For a particular type, such as the comforter container-cover 60 of FIG. 7, the same insulator pads 70 will fit into container-covers of any desired multiple component width.

Insulator pad units are covered in a cloth processed with a schreiner type or calendar finish to result in a smooth, glazed and low abrasive surface facilitating their insertion into the compartments of the comforter container-cover. The covers of the insulator pads may be stitched to the extent of one-eighth of an inch about all four sides to form defined edges so as to cause them to find their place inside the comforter container-cover and also to cause them to stay in place while in use. The stitched edges will prevent the insulator pads from rotating inside the compartments of the comforter container-cover. While two examples of the pull rods have been illustrated, pull rods of different lengths, hook shapes and handle shapes may be utilized as required for convenience of use.

While the container-covers have been described in terms of a face side and an under side, such container-covers in use are reversible. Different decorative designs may be displayed by the face side or under side. The container-cover may be readily laundered or dry cleaned without requiring immersing the insulator pads unnecessarilly in washing or dry cleaning solutions that may impair their insulation properties. The container-cover can then be put back into use or stored away and replaced by a container-cover made of a different fabric or of a different decorative design or color to suit the desire of the user.

Storage of the dissassembled container-covers and pads takes up less space than that of bulky conventional quilts, since the bulky insulator pads remain in use and only the container-covers are stored away, taking up little more space, when folded, than sheets. Additional pads for other size container-covers or for seasonal changes are readily stored on a shelf or in a box.

Container-covers may be also used, alone, without installation of insulator pads, as a decorative bed cover, or as a light-weight blanket, in summer.

When the comforter is assembled using insulator pad units of uniform characteristics, the position of the insulator pads may be rotated from peripheral to mid-position locations, to provide equalization of use, since the peripheral units come into less body contact than do the in the mid-section of the comforter.

With insulator pads or units of different characteristics employed in the one assembled comforter, the heat-insulation properties and other characteristics can be varied over the area of the assembly. Heat insulator pad units for the side and foot peripheral compartments may be of a heavier physical weight than those employed in the mid-section, so as maintain the comforter in position, in use. As shown herein, the users of a comforter may tailor individual heat zones by employing insulator pad units of different insulating properties so as to provide optimum comfort for each of two simultaneous users over the general area of the comforter assembly. Thus the right hand side of a particular comforter assembly may be fitted with a range of heat insulation zones extending from the feet to the chest covering sections of the user lying under the right side of the assembly, while the left hand side of the same assembly may be configured with a completely different range of heat insulation zones extending from the foot to the head section. Since all insulator pads are readily replaced, the location of insulator pad unit pads may be shifted to empirically determine the optimum characteristics of a particular assembly.

In light of all of the aforegoing, it will be appreciated that the broad concept of the invention is that comforters of different sizes may be assembled by using cover units of different sizes (i.e. having a different number of same sized individual compartments) with different numbers of same sized heat insulator units. Thus, the cover unit and the pads are mathematically planned. With insulative units of a particular size, (e.g. approximately 18 inches by 25 inches), crib (36 by 50), twin (72 by 100), queen (90 by 100), and king (108 by 100) size comforters may be assembled for the standard size bed equivalents (a crib being considered a "bed" for purposes herein). Clearly, heat insulation units that are a fraction of the width and/or length may be used by combining the units to form the desired particular size. Thus, if the insulative units were 9 inches by 25 inches, or 6 by 12.5 inches, the same sizes could be provided. Further, using a fraction size such as 9 by 25, a comforter of 81 by 100 could be provided.

While, typically, heat insulation units that are a fraction of the compartment size may be used, it will be recognized that compartments which are half the size of the insulation units may be used if the wide openings of two adjacent compartments are located adjacent each other, and overlapping flaps are provided.

It should also be noted that while a unit size of 18 by 25 inches was provided for the heat insulative units as permitting the construction of different sized comforters, other unit sizes could be provided as desired, and it is not the intent of the inventor to be limited thereto. Further, other obvious changes may be made in the specific embodiments of the invention described herein, and such modifications being in the spirit and scope of the invention claimed, it is indicated that all matter contained herein is intended as illustrative and not as limiting in scope.

I claim:

1. System of bed coverings adapted to cover beds of different standard sizes, said set comprising:

(a) a plurality of cover units of different sizes, each cover unit having a plurality of individual compartments of substantially the same size;

(b) a plurality of heat insulator units each having substantially the same size, at least one for each of said individual compartments, wherein said individual compartments are arranged to receive and retain said heat insulator units, said heat insulator units are arranged to be insertable and removable from said compartments of said cover units, and said heat insulator units are arranged to be of a predetermined size and shape such that a first predetermined number of said heat insulator units in a cover unit having a first predetermined number of individual compartments will comprise a bed covering for a first standard sized bed, while a second predetermined number of said heat insulator units in a cover unit having a second predetermined number of individual compartments will comprise a bed covering for a second standard size bed whereby a plurality of the substantially uniformly sized heat insulator units may be used with different cover units of the system of bed coverings.

2. An article according to claim 1, wherein:

said predetermined size and shape of said heat insulator units permits a third predetermined number of said heat insulator units in a cover unit having said third predetermined number of individual compartments to comprise a bed covering for a third standard sized bed.

3. An article according to claim 2, wherein:

each heat insulator unit has a width of a multiple of approximately nine inches and a length of a multiple of approximately twenty-five inches, and said compartments are generally rectangular.

4. An article according to claim 1, wherein:

each heat insulator unit has a width of a multiple of approximately nine inches and a length of a multiple of approximately twenty-five inches, and said compartments are generally rectangular.

5. An article according to claim 1, wherein:

said heat insulator units each include at least one insulative pad and a cloth material enclosing said at least one pad, wherein said cloth material has an external surface that has been processed to produce a schreiner type alendar low abrasive surface finish.

6. An article according to claim 5, wherein:

said heat insulator unit is fabricated with edges that are stitched together so as to form projecting edges that serve to restrain said heat insulator unit from rotating in its compartment.

7. An article according to claim 1, wherein:

said heat insulator units are generally triangular in shape.

8. An article according to claim 7, wherein:

said heat insulator units are arranged such that two heat insulator units together provide a substantially rectangular shape having a width of a multiple of approximately nine inches and a length of a multiple of approximately twenty-five inches.

9. An article according to claim 1, wherein:

a first of said heat insulator units is provided with a significantly different heat insulation property than a second of said heat insulator units such that said heat insulator units may be inserted in a selective manner into said compartments of a cover unit so as to at least two selective zones of different heat insulation properties over the area of a bed covering article.

10. An article according to claim 1, wherein:

a first of said heat insulator units is formed with a material of significantly different allergenic property than a second of said heat insulator units such that said heat insulator units may be inserted in a selective manner into said compartments of a cover unit so as to at least two selective zones of different allergenic properties over the area of a bed covering article.

11. An article according to claim 1, wherein:

a cover unit is comprised of at least two sheets of fabric that are joined together to form a series of said compartments, wherein said compartments are bounded by parallel lines of seams joining the sheets of fabric.

12. An article according to claim 11, wherein:

said sheets are joined together further to form seams forming a grid pattern along longitudinal and lateral axes.

13. An article according to claim 1, wherein:

said heat insulator units each further include a fastening means to which a pulling device may be attached to permit said pad to be pulled into a compartment and then detached, and each of said compartments includes a first opening of a size to admit a heat insulator unit, and a second opening opposite said first opening of a size to admit a pulling device which may attach to said fastening means.

14. An article according to claim 13, wherein:

said second opening is of a smaller size than said first opening and is smaller than the width of a heat insulator unit such that said heat insulator unit cannot slip out of a compartment though said second opening.

15. An article according to claim 14, wherein:

each compartment is further formed with a flap means for securely covering said first opening.

16. An article according to claim 15, wherein:

said first openings of at least two compartments are located directly adjacent to each other, and said flap means for said adjacent compartments comprises a common flap means.

17. An article according to claim 15, in combination with a pulling member, said pulling member comprising:

a rigid member with an open hook section at one end for detachably engaging with said fastening means of a heat insulator unit, and a handle section at the other end adaptable for manual grasping by a user.

18. The combination of claim 17, wherein:

the handle of said pulling member is arranged such that it cannot slip through said second opening of a compartment, and said fastening means of said heat insulation unit comprises an eyelet mounted in an end section of said heat insulation unit.

* * * * *